US010629344B2

(12) United States Patent
Ramanujan et al.

(10) Patent No.: US 10,629,344 B2
(45) Date of Patent: Apr. 21, 2020

(54) MAGNETIC MATERIAL AND A METHOD OF SYNTHESISING THE SAME

(71) Applicant: ROLLS-ROYCE plc, London (GB)

(72) Inventors: Raju V Ramanujan, Singapore (SG); Harshida G Parmar, Singapore (SG); Tan Xiao, Singapore (SG)

(73) Assignee: ROLLS-ROYCE plc, London (GB)

( * ) Notice: Subject to any disclaimer, the term of this patent is extended or adjusted under 35 U.S.C. 154(b) by 294 days.

(21) Appl. No.: 15/680,879

(22) Filed: Aug. 18, 2017

(65) Prior Publication Data

US 2018/0130579 A1 May 10, 2018

(30) Foreign Application Priority Data

Nov. 4, 2016 (GB) ..... 1618592.8

(51) Int. Cl.
*H01F 1/057* (2006.01)
*B22F 1/00* (2006.01)
(Continued)

(52) U.S. Cl.
CPC ..... *H01F 1/0573* (2013.01); *B22F 1/0044* (2013.01); *B22F 3/02* (2013.01);
(Continued)

(58) Field of Classification Search
CPC .. H01F 1/0573; H01F 41/0253; H01F 1/0553; C22C 33/0235; C22C 38/06;
(Continued)

(56) References Cited

U.S. PATENT DOCUMENTS 5,044,613 A 9/1991 Kumar et al.
5,466,307 A 11/1995 Tong et al.
(Continued)

FOREIGN PATENT DOCUMENTS

CN 103182514 A 7/2013
CN 103317142 A 9/2013
(Continued)

OTHER PUBLICATIONS

Ramanujan et al. "Novel microwave assisted chemical synthesis of Nd2Fe14B hard magnetic nanoparticles", 2013, RSC Publishing, Nanoscale, 5, p. 2718-2725 (Year: 2013).*
(Continued)

*Primary Examiner* — Alexandra M Moore
*Assistant Examiner* — Adil A. Siddiqui
(74) *Attorney, Agent, or Firm* — Oliff PLC

(57) ABSTRACT

A process for producing Co, Al alloyed NdFeB nanoparticles, by a microwave assisted combustion process, followed by a reduction diffusion process, includes the steps of: preparing a first solution of boric acid dissolved in 4 N $HNO_3$, dissolving iron nitrate nonahydrate, neodymium nitrate hexahydrate, cobalt nitrate hexahydrate, aluminium nitrate, the first solution in deionized water to form a second solution, adding glycine to the second solution in a molar ratio of 1:1 to form a third solution, subjecting the third solution to microwave radiation, thereby forming an first powder of NdFeCoAlB oxides, mixing the first powder with calcium hydride in a mass ratio of 1:1.1 (NdFeCoAlB oxides:$CaH_2$) to form a second powder, compacted into a powder block, annealing the second powder in a vacuum furnace, washing the annealed second powder with a solution of ethylenediaminetetraacetic acid; and vacuum drying the second powder.

7 Claims, 6 Drawing Sheets

(51) Int. Cl.

| | |
|---|---|
| ***B22F 9/24*** | (2006.01) |
| ***B22F 3/24*** | (2006.01) |
| ***B22F 3/02*** | (2006.01) |
| ***H01F 1/055*** | (2006.01) |
| ***C22C 38/10*** | (2006.01) |
| ***C22C 38/00*** | (2006.01) |
| ***H01F 41/02*** | (2006.01) |
| ***C22C 38/06*** | (2006.01) |
| ***C22C 33/02*** | (2006.01) |

(52) U.S. Cl.
CPC ..... *B22F 3/24* (2013.01); *B22F 9/24* (2013.01); *C22C 33/0235* (2013.01); *C22C 38/002* (2013.01); *C22C 38/005* (2013.01); *C22C 38/06* (2013.01); *C22C 38/10* (2013.01); *H01F 1/0553* (2013.01); *H01F 41/0253* (2013.01); *B22F 2003/248* (2013.01); *B22F 2201/20* (2013.01); *B22F 2202/11* (2013.01); *B22F 2301/355* (2013.01); *B22F 2304/054* (2013.01); *C22C 2200/04* (2013.01); *C22C 2202/02* (2013.01)

(58) Field of Classification Search
CPC ..... C22C 38/005; C22C 38/002; C22C 38/10; C22C 2200/04; C22C 2202/02; B22F 9/24; B22F 3/24; B22F 3/02; B22F 1/0044; B22F 2304/054; B22F 2301/355; B22F 2202/11; B22F 2201/20; B22F 2003/248; B22F 2998/10; B22F 9/20
See application file for complete search history.

(56) References Cited

U.S. PATENT DOCUMENTS

| | | | | |
|---|---|---|---|---|
| 6,051,047 | A * | 4/2000 | Zhou | B22F 9/24 75/349 |
| 6,517,934 | B1 * | 2/2003 | Kishimoto | C22C 1/0441 148/100 |
| 8,075,664 | B1 * | 12/2011 | Wang | B01J 13/02 75/252 |
| 2014/0128252 | A1 * | 5/2014 | Hosono | C01G 23/003 502/350 |
| 2019/0126354 | A1 * | 5/2019 | Huber | B22F 9/04 |

FOREIGN PATENT DOCUMENTS

| | | | |
|---|---|---|---|
| CN | 103317146 | A * | 9/2013 |
| CN | 103317146 | A | 9/2013 |
| CN | 104821218 | A * | 8/2015 |
| JP | 2007039794 | A * | 2/2007 |
| KR | 100828933 | B1 | 5/2008 |

OTHER PUBLICATIONS

Gjoka et al. "Experimental Proof of Microwave Sintering of Nd—Fe—B Powders Toward Fabrication of Permanent Magnets", 2014, IEEE, Transactions of Magnetics, vol. 50, No. 11, pp. 1-4 (Year: 2014).*
Espacenet Machine Translation of CN 104821218 A (Year: 2019).*
Espacenet Machine Translation of JP 2007039794 A (Year: 2019).*
May 5, 2017 Search Report issued in British Patent Application No. 1618592.8.
Feb. 15, 2018 Search Report issued in European Application No. 17186926.

* cited by examiner

Sample_120K_1.tif
Print Mag: 861000x @7.0 in
11:04:13 a 05/27/15
TEM Mode: Imaging 20 nm
HV=200.0kV
Direct Mag: 120000x
X: 37 Y: −242 T:
AMT Camera System

MAGNETIC MATERIAL AND A METHOD OF SYNTHESISING THE SAME

This disclosure claims the benefit of UK Patent Application No. GB 1618592.8, filed on 4 Nov. 2016, which is hereby incorporated herein in its entirety.

FIELD OF THE DISCLOSURE

The present disclosure relates to a process for producing a NdFeB magnetic material and particularly, but not exclusively, to a process for producing a NdFeB magnetic material for use in electrical machines.

BACKGROUND TO THE DISCLOSURE

Conventional hard magnetic materials are generally formed from rare earth materials, which are expensive and their supply can be problematic. Hard magnetic materials are widely used in large variety of electrical systems, machines and devices, such as, for example, electric motors, electrical generators, hard disk drives, electric and hybrid vehicles, etc.

There is therefore a need for a high performance hard magnetic material composition having a low rare earth material content.

One such composition is Nd—Fe—B which is a hard magnetic material already used in many industrial applications. To date, the experimental behaviour of exchange-coupled Nd—Fe—B magnetic materials has not matched the predicted magnetic properties.

For example, the predicted magnetic properties of exchange-coupled Nd—Fe—B magnets are considerably higher than the experimental values obtained so far. The predicted values are based on efficient exchange coupling, which can only be obtained at the nanoscale level through nanostructured materials.

It is known to produce Nd—Fe—B magnetic materials using techniques such as melt spinning, ball milling and HDDR methods. These methods involve a series of processing steps such as, for example, homogenization at high temperature, melting, casting, and milling, followed by annealing to obtain the final product. A known problem with these techniques is that they need an excess amount of Nd in order to compensate for the evaporation loss.

STATEMENTS OF DISCLOSURE

According to a first aspect of the present disclosure there is provided a process for producing Co, Al alloyed NdFeB nanoparticles, by a microwave assisted combustion process, followed by a reduction diffusion process, the process comprising the steps of:

- preparing a first solution of boric acid dissolved in 4 N Nitric Acid ($HNO_3$);
- dissolving iron nitrate nonahydrate, neodymium nitrate hexahydrate, cobalt nitrate hexahydrate, aluminium nitrate, and the first solution in deionized water to form a second solution;
- adding glycine to the second solution in a molar ratio of 1:1 to form a third solution;
- subjecting the third solution to microwave radiation, thereby forming an first powder of NdFeCoAlB oxides;
- mixing the first powder with calcium hydride in a mass ratio of 1:1.1 (NdFeCoAlB oxides:$CaH_2$) to form a second powder, compacted into a powder block;
- annealing the second powder in a vacuum furnace;

- washing the annealed second powder with a solution of ethylenediaminetetraacetic acid; and
- vacuum drying the second powder.

The process of the disclosure has an advantage that the quantity of amorphous boron required for the reduction diffusion process is reduced over the prior art synthesis techniques.

A further advantage of the process of the disclosure is that starting materials are the salts of iron, neodymium, cobalt and aluminium rather than elemental powder. This makes the process considerably more cost effective than conventional synthesis processes that require the elemental forms of these materials.

The magnetic properties of the NdFeB material produced by the process of the disclosure are improved over those of the prior art synthesis techniques.

In the initial step of the process, boric acid is used as source of boron. The use of boric acid will produce boron oxide and will react with $CaH_2$, to form the desired Nd—Fe—Co—Al—B hard magnetic phase.

The boric acid is oxidised during the microwave heating step and is converted to boron oxide. This boron oxide is subsequently reduced as boron during the reduction diffusion steps and subsequently forms the NdFeCoAlB hard phase material.

An advantage of the process of the present disclosure is that the use of microwave heating results in a more rapid heating rate, more uniform heating (minimising temperature gradients within the material) and lower energy consumption in comparison to prior art heating methods such as, for example, electric heating or vapour heating.

An advantage of the process of the present disclosure is that the use of boric acid avoids the problem of boron hydride evaporation that is present in the prior art synthesis techniques. The use of boric acid also reduces the possibility of the formation of boron deficient phases.

An advantage of the process of the present disclosure is that the use of a solution of ethylenediaminetetraacetic acid in methanol and triethanolamine, acts to remove the non-magnetic calcium oxide (CaO) by-product, and so reduces the absorption of hydrogen in the magnetic phase. This in turn improves the coercivity of the final magnetic material over that produced by prior art synthesis techniques.

Optionally, the step of subjecting the third solution to microwave radiation comprises the step of:

- subjecting the third solution to microwave radiation of approximately 330 W for a duration of approximately 10 minutes.

The step of microwave heating of the third solution results in the evaporation of water and other volatile species. This evaporation enables an exothermic reaction between the nitrate salts and the glycine results in the third solution being converted to an ultra-fine NdFeCoAlB oxide powder.

This in turn reduces the absorption of hydrogen by the third solution, which in turn results in an improvement in the magnetic properties of the end product.

Optionally, the step of annealing the second powder in a vacuum furnace, comprises the step of:

- annealing the second powder in a vacuum furnace at a temperature of 800° C. for 2 hours.

The treatment of the second powder in a vacuum furnace causes reduction of the second powder.

Optionally, the step of annealing the second powder in a vacuum furnace, comprises the steps of:

- forming the second powder into a compacted powder block;
- providing an inert gas atmosphere; and subjecting the compacted powder block to microwave radiation, within the inert gas atmosphere, to form an annealed second powder.

The use of microwave radiation to anneal the second powder means that the entire process of the present disclosure may be carried out using only microwave radiation for the processing steps. This in turn means that the entire process can be completed using only a single processing container. This removes the need to transfer intermediate compounds between processing containers and so makes the process of the disclosure more convenient, and considerably quicker, and more cost effective than prior art processes.

An advantage of the process of the present disclosure is that the use of microwave heating results in a more rapid heating rate, more uniform heating (minimising temperature gradients within the material) and lower energy consumption in comparison to prior art heating methods such as, for example, electric heating or vapour heating.

Optionally, the step of subjecting the compacted powder block to microwave radiation, within the inert gas atmosphere, comprises the preceding step of:

positioning the compacted powder block in a silicon carbide (SiC) powder bath.

The low dielectric factor of ferrite materials, such as the intermediates of the process of the present disclosure, means that the second powder is difficult to heat using microwave radiation from near room temperatures. As the temperature of the second powder increases, the mixed oxides begin to absorb microwave energy more rapidly because the dielectric loss constant of the second powder increases with temperature.

The high dielectric loss of silicon carbide allows it to be used as a microwave susceptor to absorb electromagnetic energy and convert it to heat.

Optionally, the step of washing the annealed second powder with a solution of ethylenediaminetetraacetic acid, comprises the further step of:

further washing the annealed second powder with methanol.

The use of methanol to provide a secondary wash of the annealed second powder assists in removing the non-magnetic calcium oxide by-product.

Optionally, the solution of ethylenediaminetetraacetic acid, is a solution of ethylenediaminetetraacetic acid in methanol and triethanolamine.

FIG. 1 shows the chemical formula for ethylenediaminetetraacetic acid. Ethylenediaminetetraacetic acid (EDTA) is a chelating agent with a high affinity for $Ca^{2+}$. $Ca^{2+}$ tends to be bounded with EDTA to form complexants (illustrated in FIG. 2), which can be utilized to remove CaO. As EDTA was able to dissolve in basic solution, triethanolamine was used to dissolve EDTA. Methanol was added to reduce the viscosity for easier stirring of the liquid and separation of powder from the liquid.

According to a second aspect of the present disclosure there is provided a compound of $Nd_{15}Fe_{59}Co_{15}Al_3B_8$ in nanoparticle form obtainable by the method of the first aspect.

Optionally, the compound has a tetragonal structure having a P42/mnm space group.

The $Nd_{15}Fe_{59}Co_{15}Al_3B_8$ hard magnetic phase material has a tetragonal structure. The calculated lattice parameters derived from a Rietveld analysis of X-ray diffraction analysis data is a (Å)=8.7826±12 and c (Å)=12.2101±11.

According to a third aspect of the present disclosure there is provided Co, Al alloyed NdFeB nanoparticles obtainable by the method of the first aspect.

Optionally, the Co, Al alloyed NdFeB nanoparticles have a mean crystallite size of between 30 nm and 50 nm.

Other aspects of the disclosure provide devices, methods and systems which include and/or implement some or all of the actions described herein. The illustrative aspects of the disclosure are designed to solve one or more of the problems herein described and/or one or more other problems not discussed.

BRIEF DESCRIPTION OF THE DRAWINGS

There now follows a description of an embodiment of the disclosure, by way of non-limiting example, with reference being made to the accompanying drawings in which.

It is noted that the drawings may not be to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
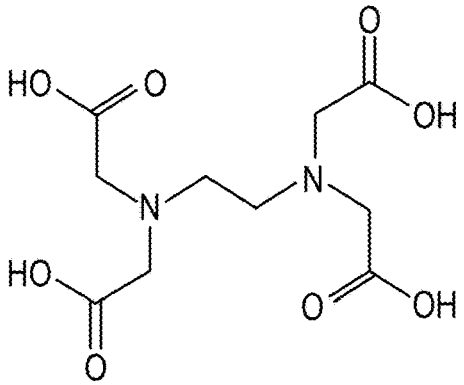
FIG. 1 shows the chemical compound of ethylenediaminetetraacetic acid (EDTA)
Figure 2:
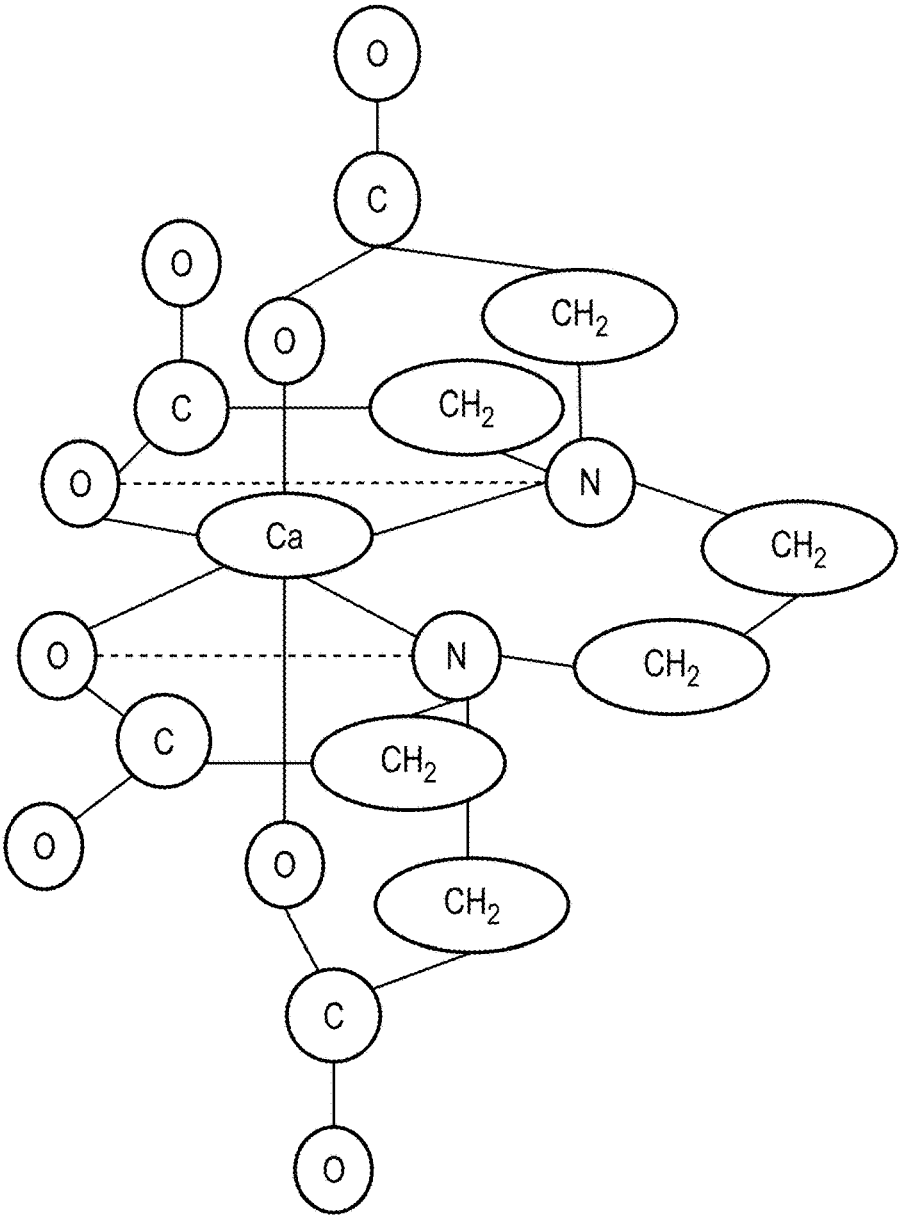
FIG. 2 shows a schematic representation of the complexants after the reactions of CaO, EDTA and triethanolamine.
Figure 3:
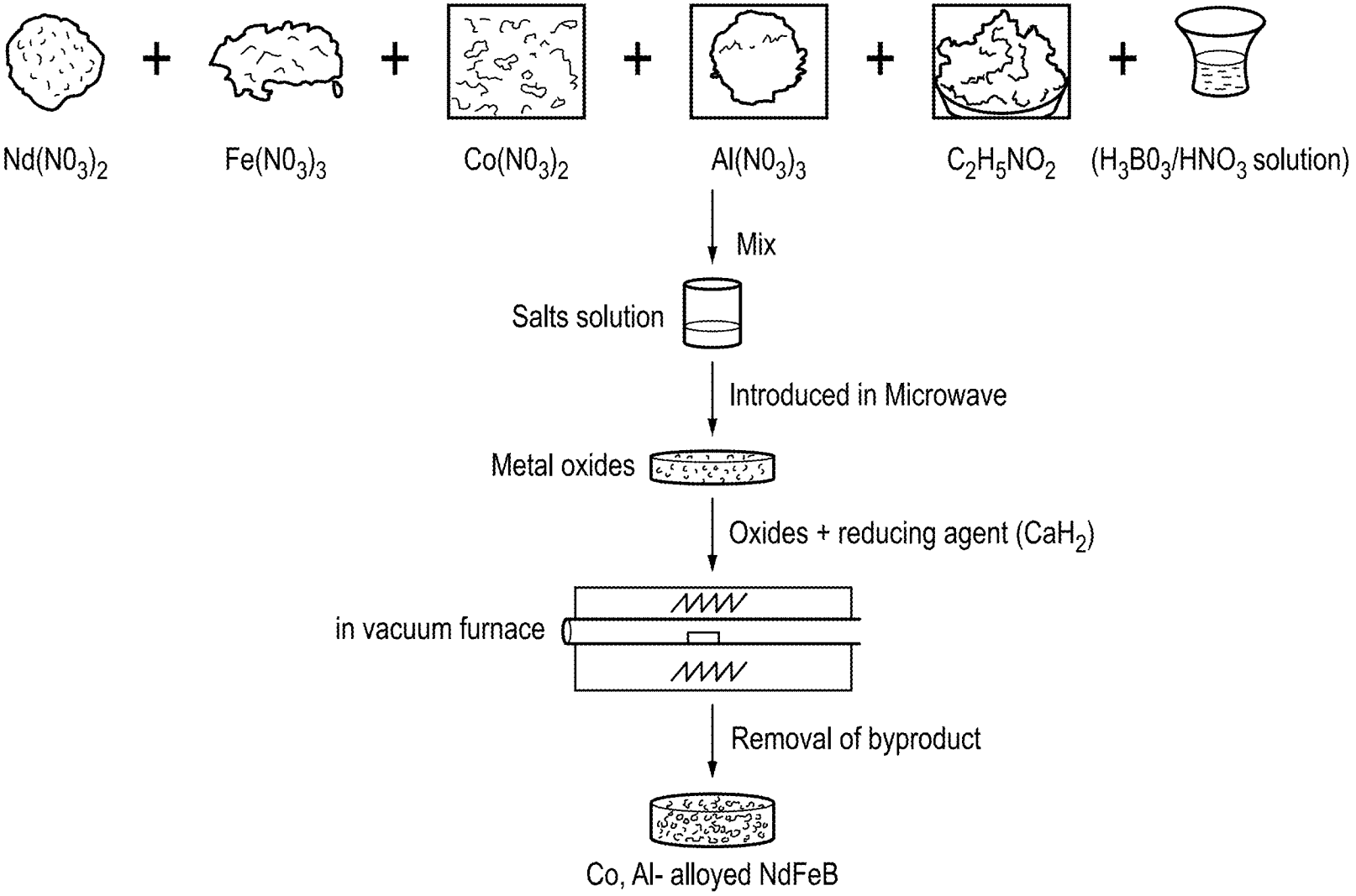
FIG. 3 shows a schematic flowchart for a process for producing Co, Al alloyed NdFeB nanoparticles according to a first embodiment of the disclosure.

FIG. 3 illustrates schematically a process for the production of Co, Al alloyed NdFeB nanoparticles according to a first embodiment of the disclosure.

A first solution is prepared by dissolving boric acid in 4N Nitric Acid ($HNO_3$).

This first solution is then combined with calculated amounts of iron nitrate nonahydrate ($Fe(NO_3)_3$), neodymium nitrate hexahydrate ($Nd(NO_3)_3$), cobalt nitrate hexahydrate ($Co(NO_3)_2$), aluminium nitrate ($Al(NO_3)_3$), and dissolved in deionized water to form a second solution.

Glycine ($C_2H_5NO_2$) is added to the second solution in a molar ratio of 1:1 (second solution:glycine) to obtain a stable third solution.

The third solution is then subjected to microwave irradiation at a low microwave power of 330 W for 10 minutes. In one example of the process, a Sharp Model R-899R household microwave oven was used to generate the microwave irradiation.

Microwave heating of the third solution results in evaporation of water and other volatiles from the third solution. Due to the exothermic reaction of nitrate salts and glycine the third solution is spontaneously converted to a first powder, being an ultra-fine Nd—Fe—Co—Al—B oxide powder.

The desired $Nd_{15}Fe_{59}Co_{15}Al_3B_8$ nanoparticles are then synthesized by mixing the first powder (the Nd—Fe—Co—Al—B oxide powder) with calcium hydride ($CaH_2$) in a mass ratio of 1:1.1 (Nd—Fe—Co—Al—B oxides:$CaH_2$) to form a second powder, compacted into a block. The second powder is then annealed in a vacuum furnace.

Figure 5:
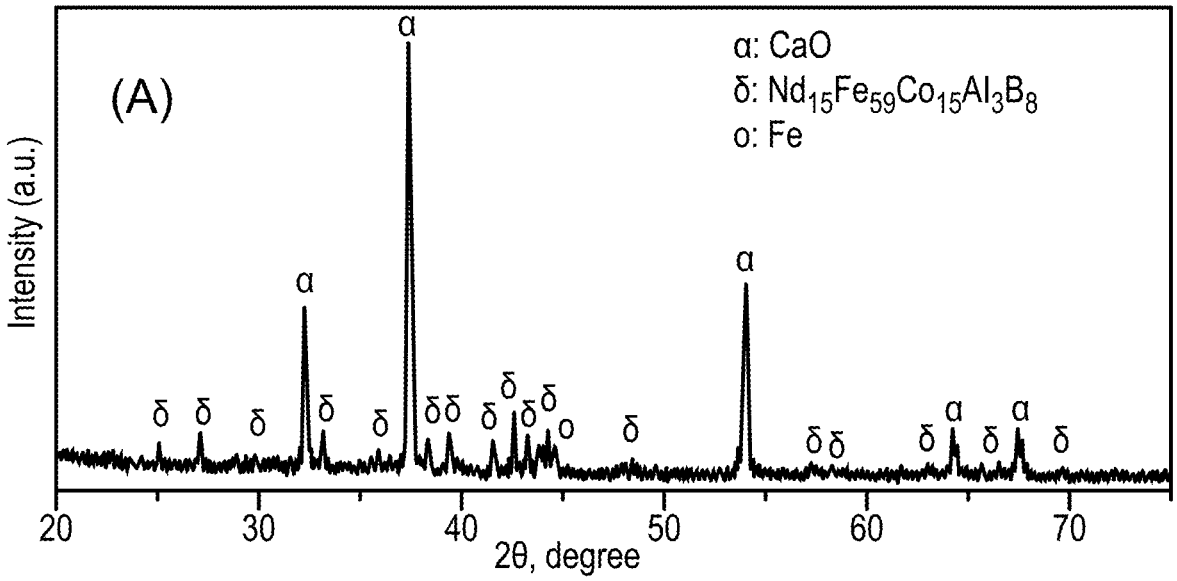
FIG. 5 shows a typical X-ray diffraction pattern for the NdFeCoAlB powder produced by the process of FIG. 3

Reduction is then carried out at 800° C. for 2 hours to form a powder containing the desired hard magnetic phase $Nd_{15}Fe_{59}Co_{15}Al_3B_8$ together with a soft magnetic phase α-Fe, with a non-magnetic calcium oxide (CaO) by product, as shown in the x-ray diffraction pattern of FIG. 5.

The annealed second powder is then washed to remove the calcium oxide (CaO) by-product. The annealed second powder is washed with an ethylenediaminetetraacetic acid (EDTA) solution (a solution of ethylenediaminetetraacetic acid in methanol and triethanolamine) to remove the non-magnetic calcium oxide by-product.

Figure 6:
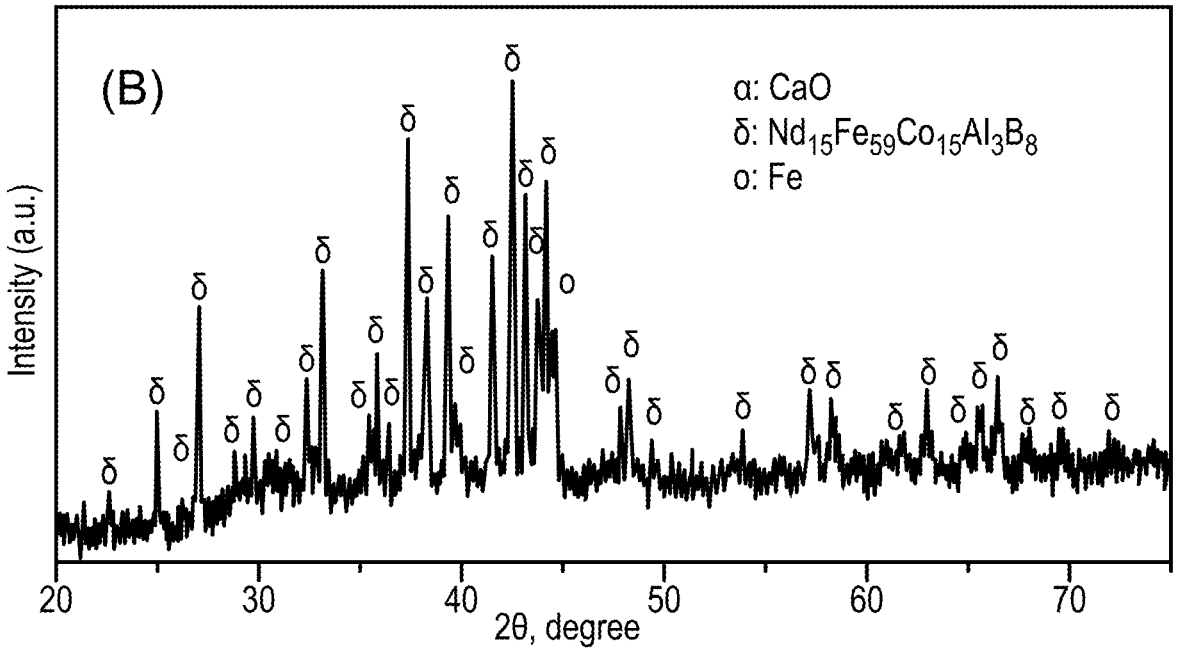
FIG. 6 shows a typical X-ray diffraction pattern for the NdFeCoAlB powder of FIG. 5 after removal of the CaO by-product.

The washed annealed second powder is then further washed in methanol. This second washing step is followed by vacuum drying to obtain the dried second powder. FIG. 6 illustrates the x-ray diffraction pattern of the washed second powder after the removal of the CaO by-product.

Figure 4:
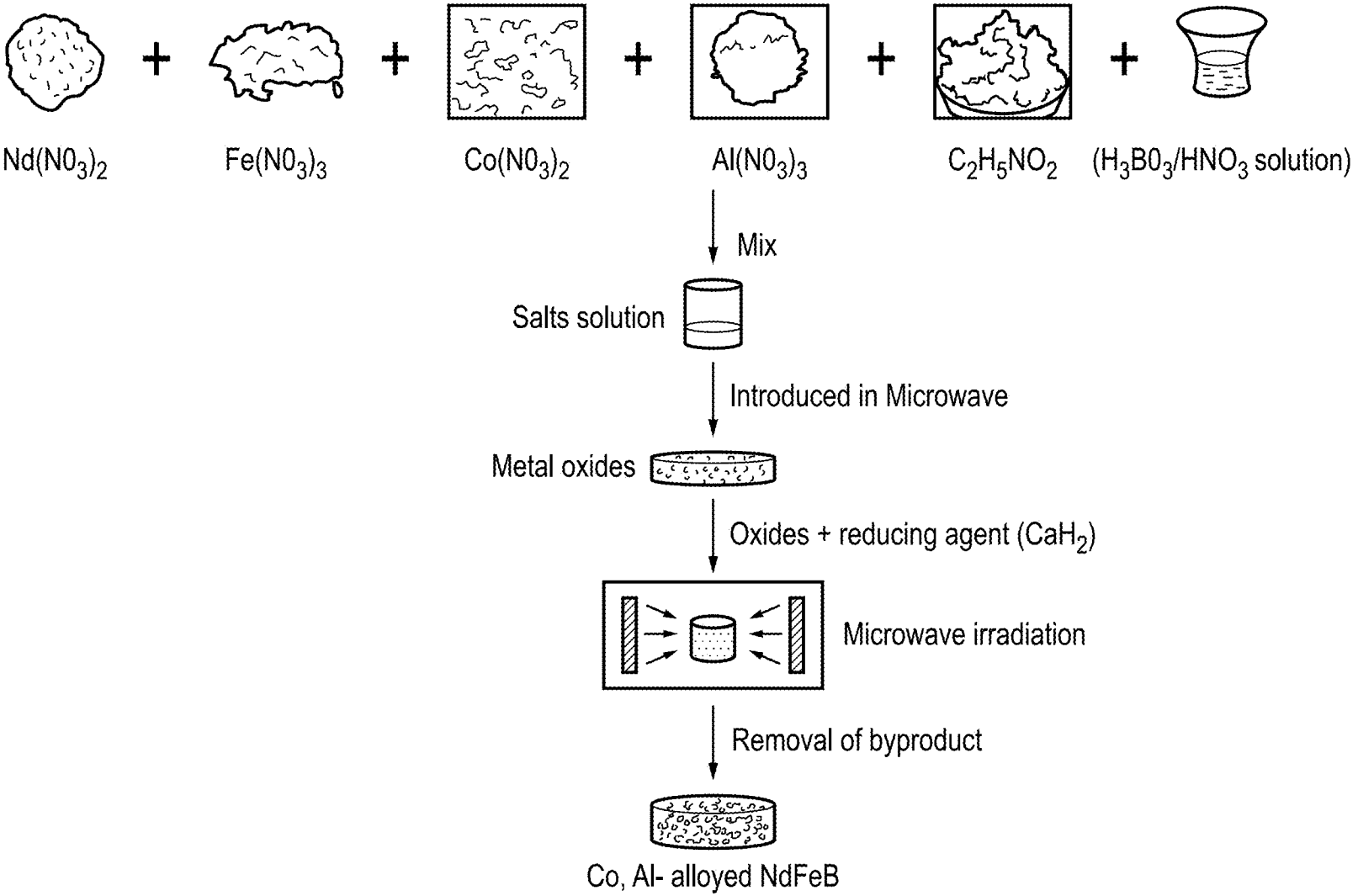
FIG. 4 shows a schematic flowchart for a process for producing Co, Al alloyed NdFeB nanoparticles according to a second embodiment of the disclosure.

FIG. 4 illustrates schematically a process for the production of Co, Al alloyed NdFeB nanoparticles according to a second embodiment of the disclosure. The process according to the second embodiment is substantially identical to the process of the first embodiment as described above.

A first solution is prepared by dissolving boric acid in 4N Nitric Acid ($HNO_3$).

This first solution is then combined with calculated amounts of iron nitrate nonahydrate ($Fe(NO_3)_3$), neodymium nitrate hexahydrate ($Nd(NO_3)_3$), cobalt nitrate hexahydrate ($Co(NO_3)_2$), aluminium nitrate ($Al(NO_3)_3$), and dissolved in deionized water to form a second solution.

Glycine ($C_2H_5NO_2$) is added to the second solution in a molar ratio of 1:1 (second solution:glycine) to obtain a stable third solution.

The third solution is then subjected to microwave irradiation (for example, using Dawnyx Technologies Pte Ltd, Model HTVF-3) at a low microwave power of 1200 W for 10 minutes.

The first powder (the Nd—Fe—Co—Al—B oxide powder) is then mixed with calcium hydride ($CaH_2$) in a mass ratio of 1:1.1 (Nd—Fe—Co—Al—B oxides:$CaH_2$) to form a second powder.

In contrast to the first embodiment, the annealing of the second powder involves the use of microwave radiation to perform the annealing step.

The second powder is formed into a compacted powder block. The compacted powder block is then placed into a powder bed of silicon carbide (SiC). The SiC powder bed is then provided with an insulating sleeve. The SiC powder bed is provided with a stirrer mechanism to agitate the powder bed during the microwave annealing process step.

The SiC powder bed with the compacted powder block of the second powder is placed inside a microwave enclosure. In this arrangement, the microwave irradiation is carried out in an Ar atmosphere. In other arrangements the reduction diffusion may be carried out using a different inert gas.

In this arrangement, the microwave power was controlled to achieve a heating rate of 3° C./minute and an 800° C. temperature. The compacted powder block was held at the 800° C. temperature for a duration of two hours to complete the annealing reaction.

The annealed second powder is then washed to remove the calcium oxide (CaO) by-product. The annealed second powder is washed using a solution of ammonium chloride $NH_4Cl$ in methanol ($CH_3OH$) to remove the non-magnetic calcium oxide by-product. The washing step is followed by vacuum drying to obtain the dried second powder. FIG. 6 illustrates the x-ray diffraction pattern of the washed second powder after the removal of the CaO by-product.

Figure 7:
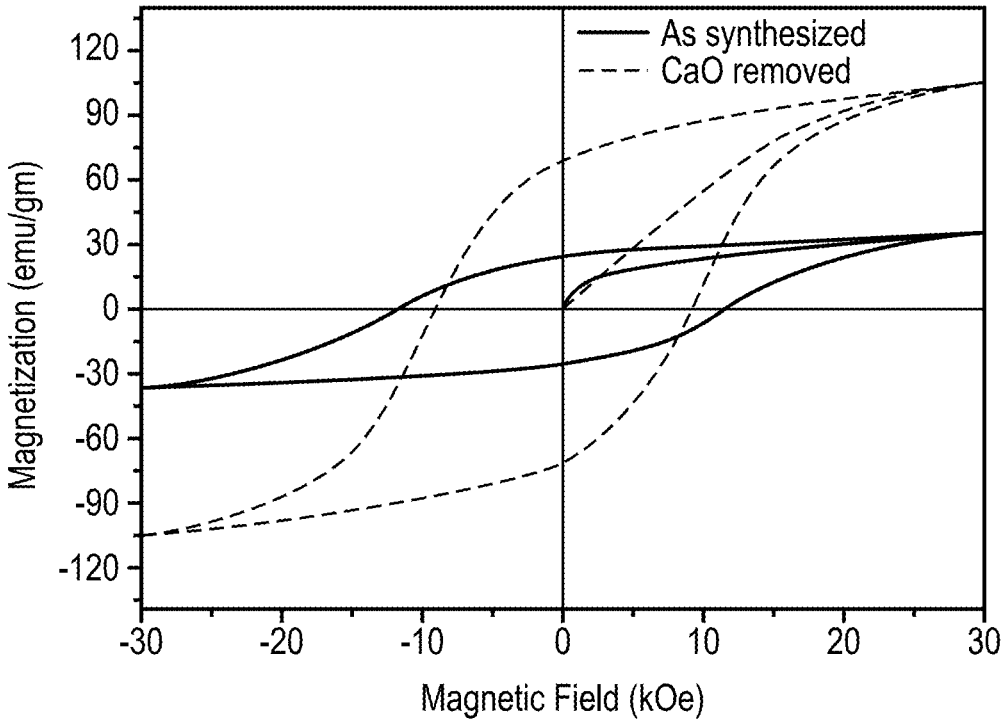
FIG. 7 shows typical hysteresis loops for NdFeCoAlB powder produced by the process of FIG. 3.

The magnetic properties at room temperature of the second powder are represented in FIG. 7 for both the as-synthesised material and for the material after the further removal of the CaO by-product.

As illustrated in FIG. 7, after the removal of the calcium oxide by-product, the resultant magnetic properties have been increased by 25% over those of the prior art. The magnetization (Ms) remanence magnetization (Mr) and coercivity (Hc) before and after calcium oxide removal are Ms=37 emu/gm, Mr=23 emu/gm, Hc=12 kOe and Ms=105 emu/gm, Mr=71 emu/gm, Hc=9.2 kOe respectively.

The ratio Mr/Ms is termed reduced remanence and is 0.5 for isotropic magnets. In the present example, the reduced magnetization for the final product of the process of the disclosure is 0.67. Since this value is greater than 0.5 it indicates that the magnetic phases are exchange coupled.

Figure 9:
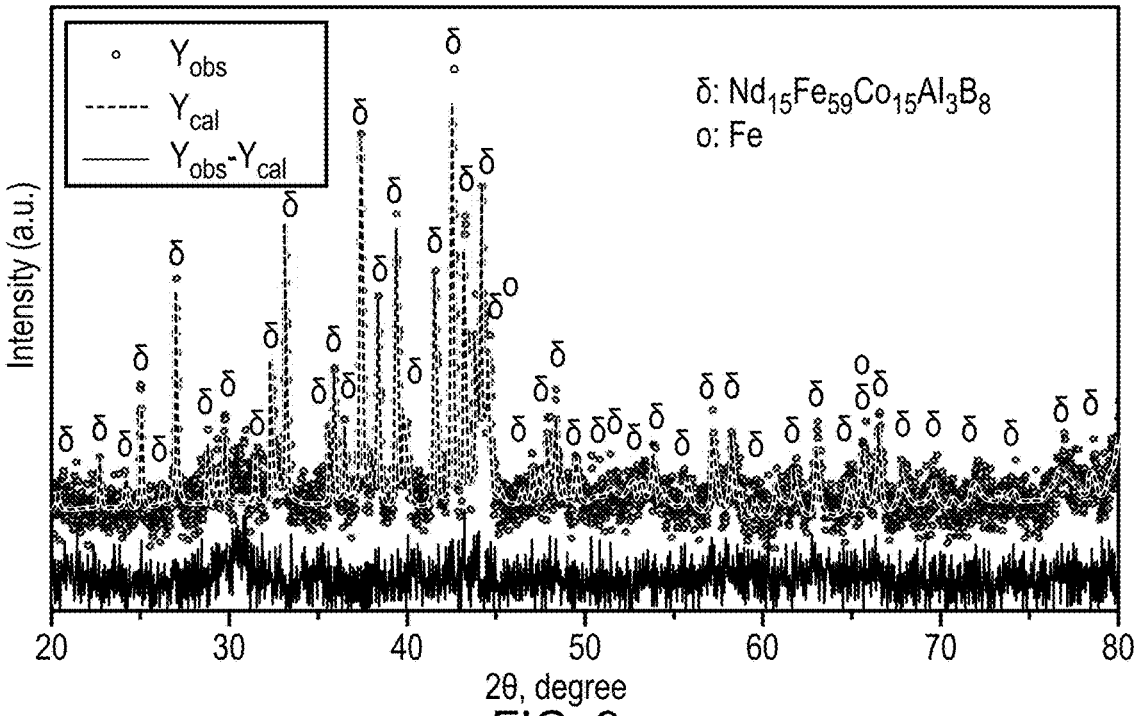
FIG. 9 shows a Rietveld refinement of NdFeCoAlB powder produced by the process of FIG. 3.
Figure 8:
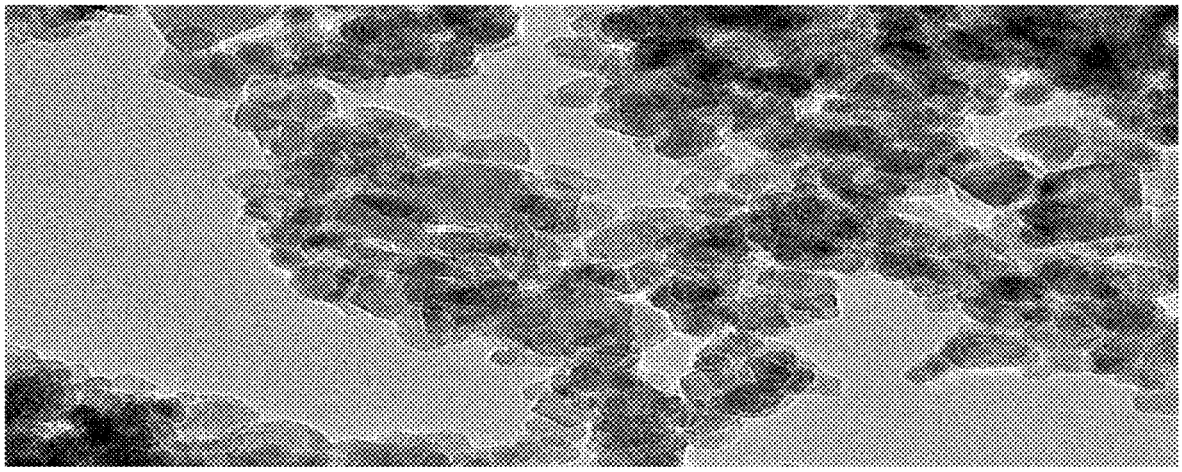
FIG. 8 shows a Transmission Electron Microcopy micrograph of NdFeCoAlB powder produced by the process of FIG. 3.

A morphological analysis of the powder material shows the particles are nano sized, as illustrated in the sample micrograph of FIG. 8. The nanoparticles are faceted, with their size varying between 7 nm to 45 nm. The Rietveld refinement of the X-ray diffraction data for the Nd—Fe—Co—Al—B powder (after removal of the CaO by-product) indicates a composition made up of 94% Nd—Fe—CO—Al—B hard magnetic phase and 6% of alpha-Fe soft magnetic phase, as illustrated in FIG. 9.

The average crystallite size calculated from Rietveld refinement of X-ray diffraction pattern was ~40 nm for Nd—Fe—Co—Al—B hard magnetic phase and ~30 nm for α-Fe soft magnetic phase.

Except where mutually exclusive, any of the features may be employed separately or in combination with any other features and the disclosure extends to and includes all combinations and sub-combinations of one or more features described herein.

The foregoing description of various aspects of the disclosure has been presented for purposes of illustration and description. It is not intended to be exhaustive or to limit the disclosure to the precise form disclosed, and obviously, many modifications and variations are possible. Such modifications and variations that may be apparent to a person of skill in the art are included within the scope of the disclosure as defined by the accompanying claims.

What is claimed is:

1. A process for producing Co, Al alloyed NdFeB nanoparticles, by a microwave assisted combustion process, followed by a reduction diffusion process, the process comprising the steps of:

preparing a first solution of boric acid dissolved in 4 N Nitric Acid ($HNO_3$);

dissolving iron nitrate nonahydrate, neodymium nitrate hexahydrate, cobalt nitrate hexahydrate, aluminium nitrate, and the first solution in deionized water to form a second solution;

adding glycine to the second solution in a molar ratio of 1:1 to form a third solution;

subjecting the third solution to microwave radiation, thereby forming a first powder of NdFeCoAlB oxides;

mixing the first powder with calcium hydride in a mass ratio of 1:1.1 (NdFeCoAlB oxides:$CaH_2$) to form a second powder, compacted into a powder block;

annealing the second powder in a vacuum furnace;

washing the annealed second powder with a solution of ethylenediaminetetraacetic acid; and vacuum drying the second powder, wherein the solution of ethylenediaminetetraacetic acid is a solution of ethylenediaminetetraacetic acid in methanol and triethanolamine.

2. The process as claimed in claim 1, wherein the step of subjecting the third solution to microwave radiation comprises the step of:

subjecting the third solution to microwave radiation of approximately 330 W for a duration of approximately 10 minutes.

3. The process as claimed in claim 1, wherein the step of annealing the second powder in a vacuum furnace, comprises the step of:

annealing the second powder in a vacuum furnace at a temperature of 800° C. for 2 hours.

4. The process as claimed in claim 1, wherein the step of washing the annealed second powder with a solution of ethylenediaminetetraacetic acid, comprises the step of:

further washing the annealed second powder with methanol.

5. A process for producing Co, Al alloyed NdFeB nanoparticles, by a microwave assisted combustion process, followed by a reduction diffusion process, the process comprising the steps of:

preparing a first solution of boric acid dissolved in 4 N Nitric Acid ($HNO_3$);

dissolving iron nitrate nonahydrate, neodymium nitrate hexahydrate, cobalt nitrate hexahydrate, aluminium nitrate, and the first solution in deionized water to form a second solution;

adding glycine to the second solution in a molar ratio of 1:1 to form a third solution;

subjecting the third solution to microwave radiation, thereby forming a first powder of NdFeCoAlB oxides;

mixing the first powder with calcium hydride in a mass ratio of 1:1.1 (NdFeCoAlB oxides:$CaH_2$) to form a second powder, compacted into a powder block;

forming the second powder into a compacted powder block;

providing an inert gas atmosphere; and subjecting the compacted powder block to microwave radiation, within the inert gas atmosphere, to form an annealed second powder;

washing the annealed second powder; and vacuum drying the second powder.

6. The process as claimed in claim 5, wherein the step of subjecting the compacted powder block to microwave radiation, within the inert gas atmosphere, comprises the preceding step of:

positioning the compacted powder block in a silicon carbide (SiC) powder bath.

7. The process as claimed in claim 5, wherein the step of washing the annealed second powder comprises:

dissolving ammonium chloride in methanol to form a fourth solution; and washing the annealed second powder in the fourth solution.

* * * * *